US005352954A

United States Patent [19]

Cirri

[11] Patent Number: 5,352,954

[45] Date of Patent: Oct. 4, 1994

[54] PLASMA GENERATOR AND ASSOCIATED IONIZATION METHOD

[75] Inventor: Gianfranco Cirri, Florence, Italy

[73] Assignee: Proel Technologie S.p.A., Florence, Italy

[21] Appl. No.: 27,403

[22] Filed: Mar. 8, 1993

[30] Foreign Application Priority Data

Mar. 11, 1992 [IT] Italy ..... FI/92/A 61

[51] Int. Cl.[5] ..... H01J 7/24

[52] U.S. Cl. ..... 315/111.21; 315/111.81

[58] Field of Search ..... 315/111.81, 111.91, 315/111.21, 111.71

[56] References Cited

U.S. PATENT DOCUMENTS

| | | | |
|---|---|---|---|
| 3,567,600 | 4/1972 | Wiegand, Jr. . | |
| 4,794,298 | 12/1988 | Proudfoot | 315/111.81 |
| 4,887,005 | 12/1989 | Rough et al. | 315/111.71 |
| 4,950,956 | 8/1990 | Asamaki et al. | 315/111.21 |
| 5,036,252 | 7/1991 | Lob | 315/111.21 |
| 5,051,659 | 9/1991 | Uhm et al. | 315/111.21 |
| 5,192,894 | 3/1993 | Teschner | 315/111.21 |
| 5,216,329 | 6/1993 | Pelleteir | 315/111.21 |

FOREIGN PATENT DOCUMENTS

| | | |
|---|---|---|
| 0132065 | 1/1985 | European Pat. Off. . |
| 0282467 | 9/1988 | European Pat. Off. . |
| 0426110 | 5/1991 | European Pat. Off. . |
| 9100910 | 6/1991 | Fed. Rep. of Germany . |
| 1496910 | 10/1967 | France . |

*Primary Examiner*—John T. Kwon
*Attorney, Agent, or Firm*—McGlew & Tuttle

[57] ABSTRACT

In the discharge chamber (21) of a device for generating plasma, used in the space sector for ion propulsion or for the discharging of satellites and in applications on the ground, suitable ionizing radiation sources (47) are provided, capable of improving the performance of said device. The radiation emitted by the sources creates constant ionization of the gas with advantages both during the preionization phase, i.e. starting of the device, and during the operating phase, standardizing the performance thereof in particular in terms of continuity and regularity of operation.

13 Claims, 3 Drawing Sheets

PLASMA GENERATOR AND ASSOCIATED IONIZATION METHOD

FIELD OF THE INVENTION

The invention relates to a gas or vapor ionization chamber for producing plasma and to a device comprising the chamber.

More particularly, the invention relates to an improvement to a device for generating plasma of the type comprising an ionization chamber, means for introducing into the chamber a gas or a vapor to be ionized, means for ionizing the gas and a system for extracting ions or electrons from the plasma generated inside the chamber.

The invention also relates to a method for generating plasma inside an ionization chamber and for extracting charged particles from the chamber.

BACKGROUND OF THE INVENTION

Devices for generating plasma from which ions or electrons are extracted are widely used in industry for effecting surface treatments (ion etching, cleaning, material deposition, ion implantation, etc.), while in the space sector they are finding widespread application as ion propulsors, as satellite charge neutralizers or as satellite/surrounding plasma contactors.

An ion generating device of the conventional type is schematically shown by way of example in FIG. 1. It comprises an ionization chamber 1 (where the plasma is generated) and an extraction system 2 which extracts the charged particles generated inside the chamber. A substance in the form of a gas or vapor is introduced into the ionization chamber, via the supply means 4, from which substance (using various methods known per se) the positive ions of the desired chemical species and free electrons are obtained. The ions are extracted from the ionization chamber, focused and accelerated towards the target by the extraction system 2. The device denoted by 3 represents a source of electrons for possible neutralization of the beam, where this is required, such as for example in the space sector, to prevent the satellite on which the device is mounted from becoming negatively charged. The electron source is not required, however, in cases where the ion generator is used for discharging a positively charged satellite. Ionization of the introduced gas produces, inside the ionization chamber 1, a plasma containing positive ions which are useful for forming the ion bee and free electrons which, when suitably further accelerated, are able to ionize other neutral atoms, thus producing further ions and free electrons. This process is sustained by a continuous supply both of neutral atoms (gases), in exchange for the extracted ions, and of electrical energy for accelerating the free electrons. The electrical energy is supplied via appropriate power supply units 5 depending on the various methods used, the most common of which are direct current discharging and discharging obtained by accelerating the electrons present using radiofrequency or microwave fields.

The process for triggering discharging is based, initially, on the transfer of energy (via radiofrequency or constant electric fields) to the free electrons present in the non-ionized gas. These electrons, usually present in very small quantities, are produced as a result of background radiation, cosmic rays, etc. The free electrons, by absorbing energy from the electric fields suitably supplied by the appropriate power supply units, trigger the process of multiplication of electrons and ions in the gas. Sometimes (in particular in devices which use radiofrequency) the quantity of free electrons present is not sufficient to trigger discharging. Delays may therefore be observed between the start of the action of the electric fields and stabilization of the plasma inside the chamber, or else electric fields of particularly high amplitude are required.

In many devices used for space applications—in ion propulsion or for neutralizing the charge of satellites—methods involving preionization of the gas with arc discharges are used or it is attempted to increase the number of free electrons inside the discharge chamber by attracting them from an external source (hollow cathode, heated filaments, etc.). These elements, when not required for other reasons, increase the complexity of the system and reduce its reliability since they are susceptible to malfunctions. This constitutes a notable drawback.

SUMMARY AND OBJECTS OF THE INVENTION

The subject of the invention is an ionization chamber and a device incorporating the chamber, which do not possess the drawbacks of conventional devices. In particular, the object of the invention is to propose an ionization chamber for plasma generators, in which preionization of the gas is possible without using components which are likely to reduce the reliability of the overall system.

Substantially, the invention proposes placing, inside the ionization chamber of a device for generating plasma, one or more ionizing radiation sources, suitably calibrated for the specific purpose and positioned in a suitable arrangement, so as to provide a fixed base for ionization of the gas, thus enabling reliable triggering of the process of multiplication of the electrons inside the ionization chamber.

Advantageous features and embodiments of the device according to the invention are described in the accompanying claims.

In particular, the ionizing radiation source or sources, which may emit $\alpha$, $\beta$, $\gamma$ or x radiation and are also known as radioactive sources, may be arranged both outside and inside the ionization chamber.

With the device according to the invention, it is possible to generate plasma from which the charged particles can be extracted using an innovative method according to which a predetermined degree of ionization is induced in the gas or in the vapor by means of ionizing radiation from a radioactive source associated with the ionization chamber.

The method according to the invention may be used in particular, but not exclusively, in all devices in which the plasma production method (radiofrequency, microwave or d.c. electric fields) is affected by the known problems of triggering and maintaining discharging or, in any case, in all devices in which it is desired to facilitate formation of the plasma. The method according to the present invention is particularly useful in the space sector for the production of discharge chambers used in ion propulsors or plasma generators in general. In fact, in addition to increasing the performance of the latter in terms of continuity and regularity of operation, it ensures that discharging is triggered without the introduction of components such as electrodes, cathode power suppliers, etc., which, themselves being subject to deterioration, give rise to problems of reliability.

The invention provides the possibility of obtaining, as required, free electrons (and ions) by simply making use of the ionization produced in the gas by the emission of ionizing radiation resulting from suitably selected and positioned sources. In this way the gas is reliably prepared for subsequent ionization in accordance with conventional methods.

The high-energy radiation tends to transfer mainly its energy to the atoms or molecules of the medium through which they pass, causing ionization thereof. For example, an $\alpha$ particle of 5 MeV of energy is able to produce, if all its energy is released in a gas (for ionization of which an average energy of 30 eV is necessary), about $1.7\times10^5$, pairs of electrons/ions. Therefore, if we consider an $\alpha$ source of 1 Ci ($=3.7\times10^{10}$ disintegrations per second), it is possible to obtain about $6\times10^{15}$ electron/ion pairs per second. By suitably positioning a source of this type in the ionization chamber, it "deposits" in the gas a power equivalent to about $3\times10^{-2}$ Watt.

However, in practice, in the case of low-pressure gas, not all the energy of the particle is released inside the gas, since a part of said energy is transferred to the walls of the ionization chamber. It is therefore necessary to assess the energy released per unit of distance of useful travel in the gas. This energy will depend on the type of radiation, on the type of gas, on its density, etc. For example, if we consider the electrons emitted by Nickel-63 (0.066 MeV) through air at a pressure of 1 mbar, it can be calculated that the energy released per cm of travel will be about 40 eV. The source of ionizing radiation must therefore be chosen, positioned and dimensioned taking account of this reduced efficiency in the transfer of energy to the gas to be ionized.

The choice as to the type of radioactive source must therefore take account of the following aspects:

1) Type of radiation emitted ($\alpha$, $\beta$, $\gamma$, x);

2) Total activity, A (becquerel), i.e. the number of disintegrations per second necessary for causing the desired degree of preionization. This parameter depends on the quantity of radioactive material used;

3) Energy E (eV) or energy spectrum of the particles emitted;

4) Average life $\tau$ (sec) of the source (>10 years for space applications);

5) dE/dx (eV/cm)=Energy released by the particles in the medium per unit of distance travelled;

6) Physical and chemical characteristics of the container inside which the radioactive material is accommodated, in relation to the requirements necessary for space applications);

7) The possibility of placing the source in an optimum position so as to obtain ionization in predetermined zones of the chamber.

The choice as to the type of radiation, its energy and activity must be made on the basis of the type of device (ion motor, plasma generator, land system, etc.), the pressure and type of gas to be ionized, and the requirements for applications in space or in fixed systems. In particular, the choice as to the type of source and radiation emitted shall also be made using specific resonances in the absorption of energy by the gas used.

An example of sources which may be advantageously used consists of Ni-63 as a $\beta^-$ emitter (maximum energy of the electrons emitted =0.066 MeV, average life 100 years) or $\alpha$ sources (Am 241, energy$\approx$5.0 MeV, average life 433 years).

The invention will be understood more clearly with reference to the description and accompanying drawing which shows a non-limiting embodiment of the invention.

DETAILED DESCRIPTION OF THE PREFERRED EMBODIMENT

Figure 1:
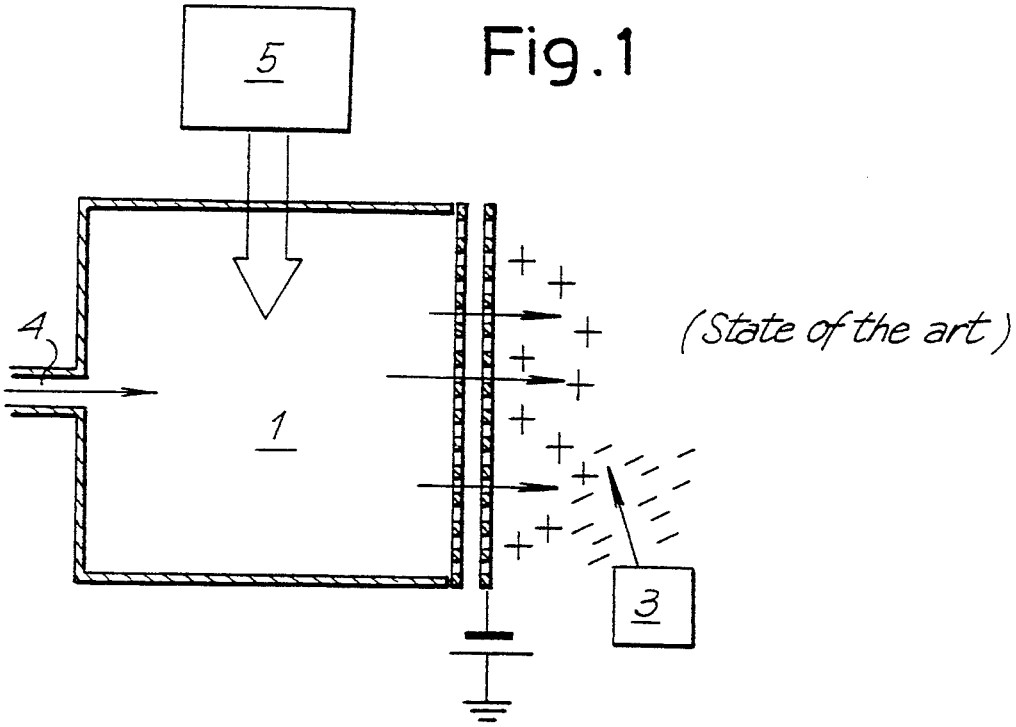
FIG. 1, described above, shows a schematic diagram of an ion generator of a known type.
Figure 2:
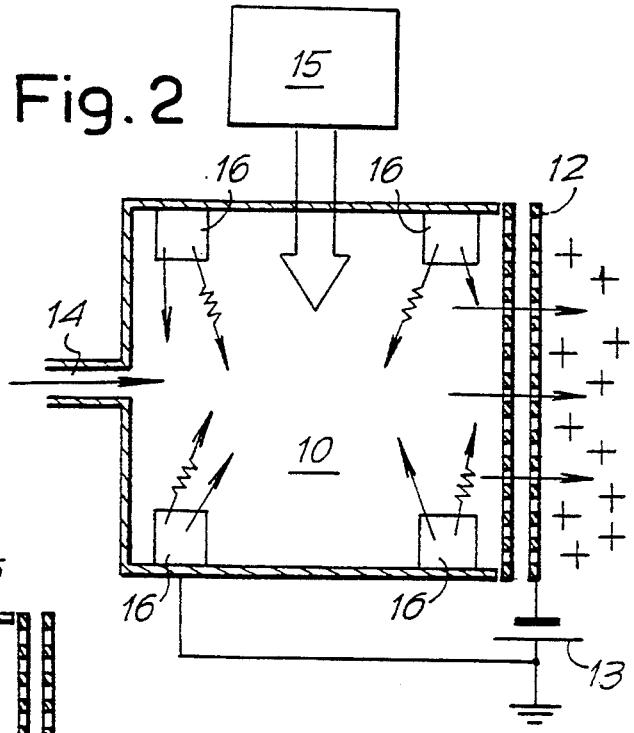
FIGS. 2 and 3 show two schematic diagrams of an ion generator and of an electron generator, respectively, with radioactive sources inside the ionization chamber.

In the diagram of FIG. 2, 10 denotes the ionization chamber, 12 a grid system for accelerating and extracting positively charged ions, connected to an acceleration voltage source 13. 14 denotes a line supplying gas into the ionization chamber and 15 denotes a power supply unit for accelerating the electrons in the plasma contained in the ionization chamber 10.

Ionizing ($\alpha$, $\beta$, $\gamma$ or x) radiation sources, denoted in the diagram by 16, are introduced inside the ionization chamber.

Figure 3:
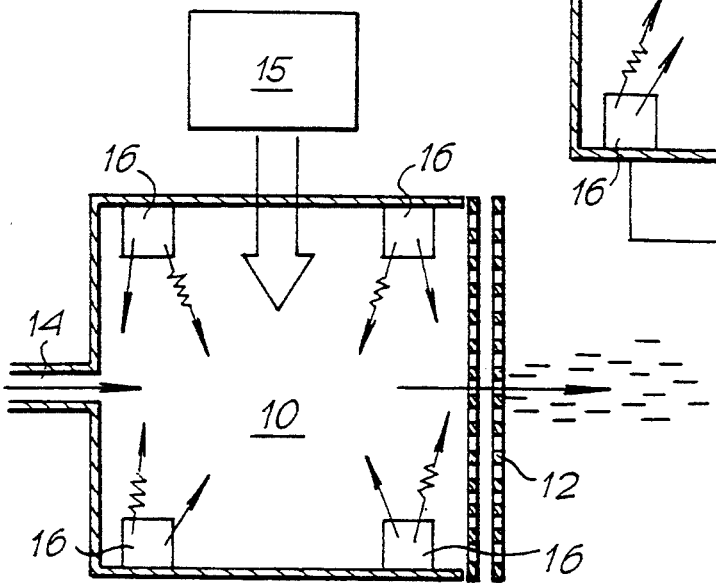

FIG. 3 shows the diagram of an electron generator. Identical parts are indicated by the same reference numbers used in FIG. 2.

Figure 4:
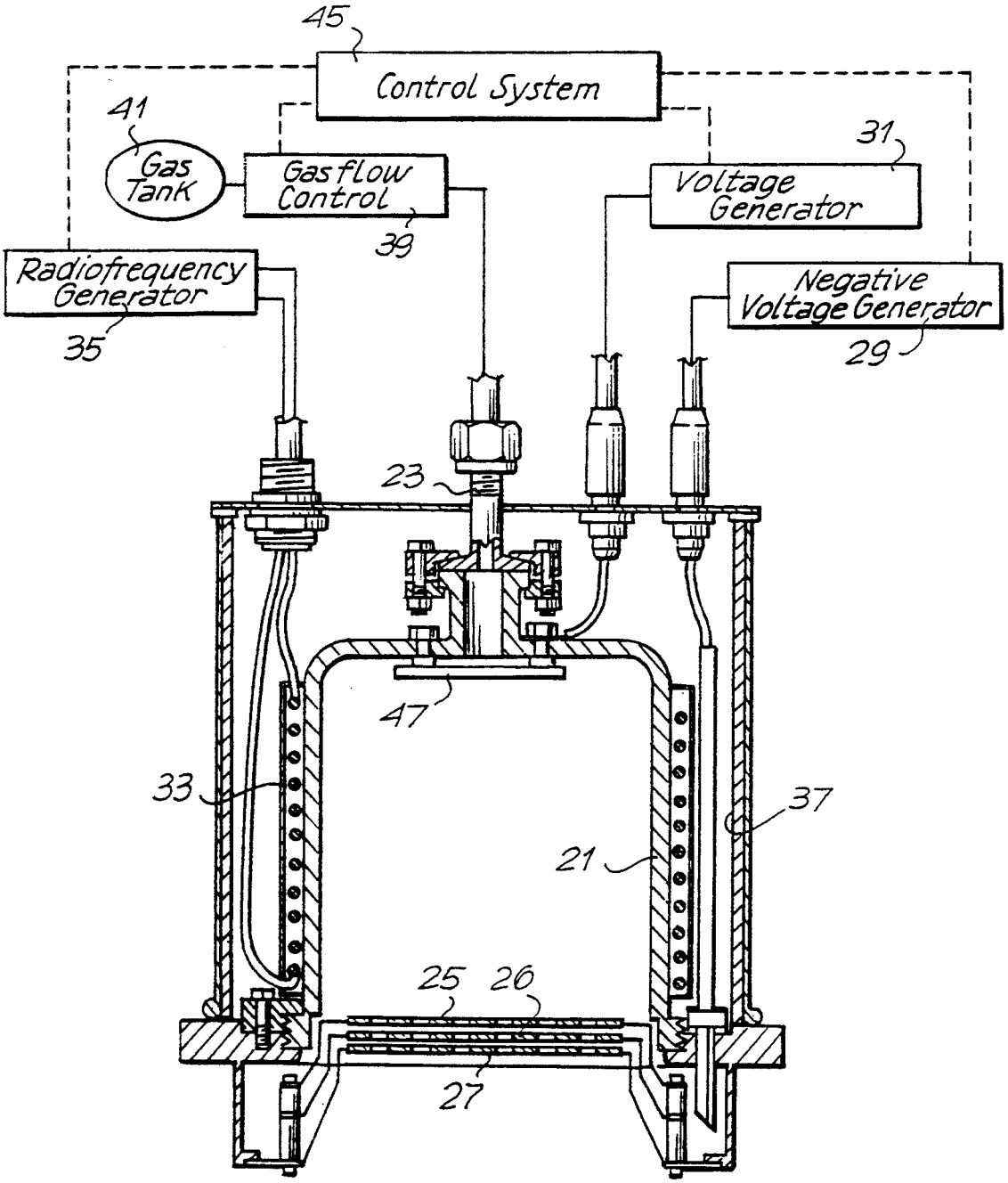
FIGS. 4 and 5 show two longitudinal sections, respectively, through an ion generator and an electron generator according to the present invention.

FIG. 4 shows a longitudinal section through an ion generator with a radiofrequency electron acceleration system.

The ionization chamber, denoted by 21, is connected to a duct 23 supplying the gas to be ionized. The front the ionization chamber is equipped with a system for extracting the ions, consisting of three grids 25, 26, 27 electrically connected to a negative voltage generator, denoted in the diagram by 29. The winding 33 of a radiofrequency generator 35 is located around the ionization chamber 21, extending in a substantially cylindrical manner. A protection screen 37 is arranged around the winding 33 in order to bound the radiofrequency field.

FIG. 4 shows, moreover, a means 39 for controlling the flow of gas through the supply duct 23, a gas tank 41 and a system 45 for controlling the ion generator.

A plate 47 of radioactive material, such as Ni-63 for example, is arranged inside the ionization chamber 21 and is connected to the generator 31 to ensure positive polarization of the plasma with respect to the environment. The plate 47 is mounted, in the example shown, by screw means. Other mounting methods are not excluded, however, such as welding directly onto the inner wall of the ionization chamber 21. The plate 47 is positioned directly in front of the outlet of the gas supply duct 23. Different positioning arrangements, however, are possible.

Figure 5:
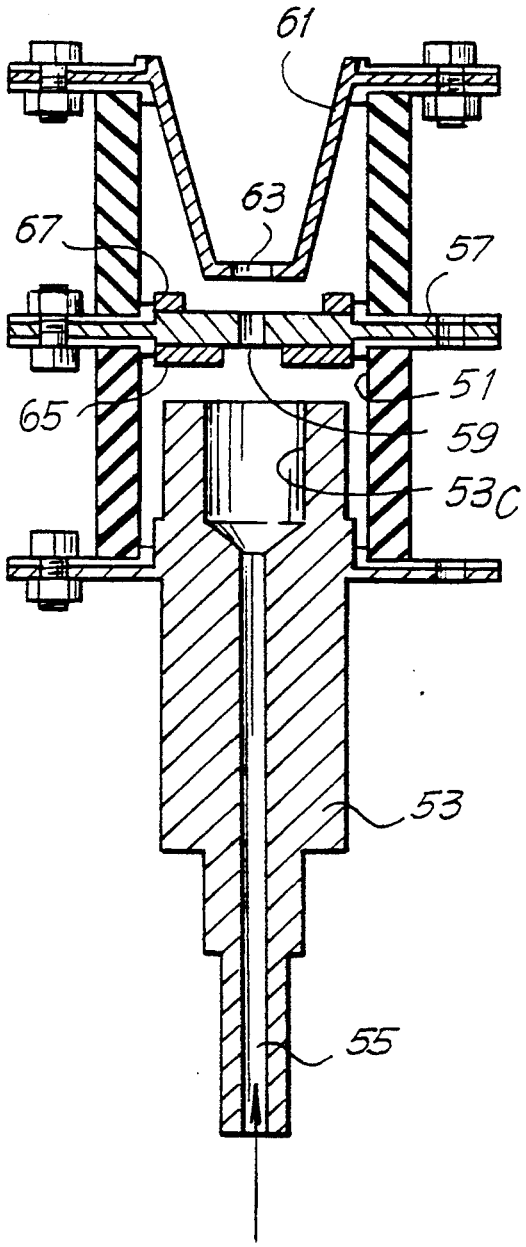

FIG. 5 shows a longitudinal section through an electron generator comprising an ionization chamber 51, inside which a hollow cathode 53 emerges. The hollow cathode 53 forms a duct 55 for supplying the gas to be ionized. Inside the ionization chamber 51 there is positioned a first anode 57 with a calibrated central hole 59 arranged in front of the outlet cavity 53C of the hollow cathode 53. The calibrated hole 59 allows the electrons to pass out to the exterior. An auxiliary anode 61 also with a central hole 63 aligned with the hole 59 is positioned in front of the anode 57. The operating principle of the device described hitherto is described in detail in U.S. patent application Ser. No. 07/844,842 in the name of the same Applicant, the contents of which are incorporated in the present description.

A first source 65 of ionizing radiation, consisting of one or more sheets of radioactive material welded to the anode, is arranged between the cathode 53 and the innermost anode 57. A second source 67 of ionizing radiation is positioned between the two anodes 57 and 61.

It is understood that the drawing shows only one example provided by way of practical demonstration of the invention, it being possible to vary the forms and arrangements without thereby departing from the scope of the idea underlying the invention.

I claim:

1. A plasma generator comprising:

a chamber;

a hollow cathode extending into said chamber;

means for introducing gas through said hollow cathode and into said chamber;

an anode positioned in said chamber and spaced from said hollow cathode, said anode defining an opening for plasma to pass through;

ionizing radiation source positioned in said chamber between said hollow cathode and said anode to inject radiation into said gas and to pre-ionize portions of said gas by transferring energy from said radiation to said portions of gas.

2. A plasma generator in accordance with claim 1, further comprising:

another anode positioned spaced from said anode and on an opposite side of said anode from said hollow cathode;

another ionizing radiation source positioned between said anode and said another anode.

3. A plasma generator for use in space vehicles, the plasma generator comprising:

a chamber;

a gas inside said chamber;

ionizing means for ionizing said gas in said chamber to form a plasma, said ionizing means including an ionizing radiation source positioned to inject radiation into said gas and to pre-ionize portions of said gas by transferring energy from said radiation to said portions of gas.

4. A plasma generator in accordance with claim 3, wherein:

said ionizing means includes a plasma field means for accelerating free electrons in said gas with electromagnetic fields in order to ionize said gas and form a plasma.

5. A plasma generator in accordance with claim 3, wherein:

said plasma field means generates radio frequency electromagnetic fields.

6. A plasma generator in accordance with claim 3, wherein:

said ionizing radiation source is positioned outside said chamber.

7. A plasma generator in accordance with claim 3, wherein:

said ionizing radiation source is positioned inside said chamber.

8. A plasma generator in accordance with claim 3, wherein:

said ionizing radiation source emits one of $\alpha$, $\beta$, $\gamma$ and x radiations.

9. A plasma generator in accordance with claim 3, wherein:

said ionizing radiation source is a radioactive source.

10. A plasma generator in accordance with claim 3, further comprising:

gas means for introducing said gas into said chamber;

said ionizing radiation source being positioned adjacent and downstream of said gas means.

11. A plasma generator in accordance with claim 3, further comprising:

extraction means for extracting charged particles from said chamber.

12. A plasma generator in accordance with claim 11, wherein:

said ionizing means produces plasma when said chamber is in communication with an outer space environment, and said extraction means extracts said charged particles from said chamber into the outer space environment.

13. A method for generating plasma in space vehicles, the method comprising the steps of:

providing a chamber in communication with an outer space environment;

introducing a gas into said chamber;

ionizing said gas in said chamber to form a plasma, said ionizing including injecting radioactive radiation from an ionizing radiation source into said gas to pre-ionize portions of said gas by transferring energy from said radiation to said portions of gas.

* * * * *